US009372473B2

(12) United States Patent
Zaugg et al.

(10) Patent No.: US 9,372,473 B2
(45) Date of Patent: Jun. 21, 2016

(54) TIMEPIECE MECHANISM COMPRISING A MOVABLE OSCILLATING COMPONENT WITH OPTIMISED GEOMETRY IN A MAGNETIC ENVIRONMENT

(71) Applicant: MONTRES BREGUET S.A., L'Abbaye (CH)

(72) Inventors: Alain Zaugg, Le Sentier (CH); Davide Sarchi, Renens (CH); Nakis Karapatis, Premier (CH); Marco Verardo, Les Bois (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/779,883

(22) PCT Filed: Mar. 17, 2014

(86) PCT No.: PCT/EP2014/055268

§ 371 (c)(1),
(2) Date: Sep. 24, 2015

(87) PCT Pub. No.: WO2014/154511

PCT Pub. Date: Oct. 2, 2014

(65) Prior Publication Data

US 2016/0085214 A1 Mar. 24, 2016

(30) Foreign Application Priority Data

Mar. 26, 2013 (EP) ..... 13161123

(51) Int. Cl.
*G04B 13/02* (2006.01)
*G04B 15/14* (2006.01)
(Continued)

(52) U.S. Cl.
CPC ..... *G04B 17/32* (2013.01); *G04B 13/026* (2013.01); *G04B 15/14* (2013.01); *G04B 17/063* (2013.01)

(58) Field of Classification Search
CPC .... G04B 13/026; G04B 15/14; G04B 17/063; G04B 17/32
USPC ..... 368/168, 169, 177
See application file for complete search history.

(56) References Cited

U.S. PATENT DOCUMENTS 1,423,446 A * 7/1922 Needy ..... G04B 17/063 29/896.31
2,706,381 A * 4/1955 Wolfe ..... G04B 17/04 29/896.31

(Continued)

FOREIGN PATENT DOCUMENTS

CH 324 249 A 9/1957
DE 11 74 518 B 7/1964

(Continued)

OTHER PUBLICATIONS

International Search Report issued Nov. 5, 2014, in PCT/EP2014/055268 filed Mar. 17, 2014.

*Primary Examiner* — Vit W Miska
(74) *Attorney, Agent, or Firm* — Oblon, McClelland, Maier & Neustadt, L.L.P

(57) ABSTRACT

A timepiece mechanism including a movable component oscillating about a rest plane passing through a pivot axis. An arbor of the movable component includes a main protruding portion which forms the largest radius of the movable component about this axis. The protruding portion is delimited by two surfaces defining a profile inscribed in a rectangle whose shape proportion is greater than 2 wherein the direction of the length defines a main axis, which occupies a determined angular position with respect to the rest plane in the rest position of the movable component. The mechanism has a preferred direction of magnetization that is substantially orthogonal to the main axis of the arbor in the rest position.

16 Claims, 2 Drawing Sheets

(51) Int. Cl.
*G04B 17/32* (2006.01)
*G04B 17/06* (2006.01)

(56) References Cited

U.S. PATENT DOCUMENTS

| | | | | |
|---|---|---|---|---|
| 3,605,401 | A | 9/1971 | Reich | |
| 3,934,406 | A * | 1/1976 | Bornand | G04B 17/32 368/177 |
| 2003/0090962 | A1 | 5/2003 | Tu et al. | |
| 2010/0054090 | A1 * | 3/2010 | Orny | G04B 17/063 368/175 |
| 2014/0198624 | A1 * | 7/2014 | Von Gruenigen | G04B 1/16 368/124 |

FOREIGN PATENT DOCUMENTS

| | | | |
|---|---|---|---|
| FR | 1 314 364 | A | 1/1963 |
| FR | 2 090 784 | A5 | 1/1972 |
| FR | 2 275 815 | A1 | 1/1976 |
| JP | 58-193478 | A | 11/1983 |
| JP | 62-63884 | A | 3/1987 |
| WO | WO 01/77759 | A1 | 10/2001 |

* cited by examiner

TIMEPIECE MECHANISM COMPRISING A MOVABLE OSCILLATING COMPONENT WITH OPTIMISED GEOMETRY IN A MAGNETIC ENVIRONMENT

CROSS-REFERENCE TO RELATED APPLICATIONS

This is a National Phase Application in the United States of International Patent Application PCT/EP2014/055268 filed on Mar. 17, 2014 which claims priority on European Patent Application No. 13161123.8 filed on Mar. 26, 2013. The entire disclosures of the above patent applications are hereby incorporated by reference.

FIELD OF THE INVENTION

The invention concerns an arbor of a movable pivoting timepiece component intended to pivot about a pivot axis and including at least one protruding portion having a larger radius around said pivot axis.

The invention also concerns a movable timepiece component including such an arbor, said arbor being made of steel, said movable component oscillating around a rest position defined by a rest plane passing through said pivot axis.

The invention also concerns a mechanism including such a movable component which is returned to said rest position by elastic return means, said mechanism having a preferred direction of magnetization.

The invention also concerns a timepiece movement including at least one such mechanism.

The invention also concerns a watch including at least one such timepiece movement and/or including at least one such mechanism.

The invention concerns the field of timepiece mechanisms, particularly the field of regulating members, in particular for mechanical watches.

BACKGROUND OF THE INVENTION

The regulating member of a mechanical watch is formed by a harmonic oscillator, the sprung-balance, whose natural oscillation frequency mainly depends on the inertia of the balance wheel and on the elastic rigidity of the balance spring.

The oscillations of the sprung-balance, otherwise damped, are maintained by the impulses provided by an escapement generally formed by one or two pivoting components. In the case of the Swiss lever escapement, these pivoting components are the pallet lever and the escape wheel. The rate of the watch is determined by the frequency of the sprung-balance and by the disturbance caused by the impulse from the escapement, which generally slows down the natural oscillation of the sprung-balance and thus causes a losing rate.

The rate of the watch is thus disturbed by any phenomena that can impair the natural frequency of the sprung-balance and/or the time dependence of the impulse supplied by the escapement.

In particular, following temporary exposure of a mechanical watch to a magnetic field, rate defects (related to residual field effects) are generally observed. The origin of these defects is the permanent magnetization of the fixed ferromagnetic components of the movement or of the external watch parts and the permanent or temporary magnetization of the moving magnetic components forming part of the regulating member (sprung-balance) and/or of the escapement.

After exposure to the field, the magnetically charged or magnetically permeable moving components (balance wheel, balance spring, escapement) are subjected to a magnetostatic torque and/or to magnetostatic forces. In principle, these interactions modify the apparent rigidity of the sprung-balance, the dynamics of the moving escapement components and friction. These modifications produce a rate defect which may vary from several tens to several hundreds of seconds per day.

The interaction of the timepiece movement with the external field, during exposure, may also result in stopping the movement. In principle, there is no correlation between stopping under a field and the residual rate defect, because stopping under a field depends on the temporary, sub-field magnetization of the components (and thus on the permeability and saturation field of the components), whereas the residual rate defect depends on residual magnetization (and thus, mainly, on the coercive field of the components) which may be low even in the presence of high magnetic permeability.

Since the introduction of balance springs made of very weakly paramagnetic materials (for example silicon), the balance spring is no longer responsible for rate defects in watches. Any magnetic disturbances still observable for magnetization fields lower than 1.5 Tesla are thus due to the magnetization of the balance staff and to the magnetization of the movable escapement components.

The pallet lever body and the escape wheel can be manufactured in very weakly paramagnetic materials without this affecting their mechanical performance. Conversely, the arbors of the movable components require very good mechanical performance (good tribology, low fatigue) to permit optimum, constant pivoting over time, and it is thus preferable to manufacture them in hardened steel (typically 20AP carbon steel or similar). Such steels are materials that are sensitive to magnetic fields because they have a high saturation field combined with a high coercive field. The balance staff and arbors of the pallet lever and escape wheel are currently the most critical components as regards magnetic disturbances of the watch.

In particular, the balance staff is the most sensitive component with respect to chronometry (residual effects), because a disturbing torque of magnetic origin acting on the arbor directly modifies the oscillation frequency of the sprung-balance, and this modification is, in principle, unlimited (it depends only on the intensity of the residual magnetic fields and on the rigidity of the balance spring), whereas a disturbance of the escapement function produces a rate defect that is limited to the nominal loss at the escapement (the resulting disturbance cannot be greater than the disturbance already produced by the escapement in normal conditions).

FR Patent Application 2275815A1 in the name of NIVAROX discloses the manufacture of a balance staff from a profile bar including several wings distributed around the pivot axis, and a variant with curvilinear wings.

FR Patent Application No 2090784A5 in the name of FEINMETALL discloses the assembly of a balance spring to a balance including a cross-member with two substantially symmetrical wings.

JP Patent Application No S6263884A in the name of ZENKOSHA TOKEI discloses the machine cutting of a balance comprising two wings.

WO Patent Application No 01/77759A1 in the name of DETRA discloses an escapement device comprising a train for transmission of energy to an oscillator capable of receiving this energy and of transmitting an oscillation frequency, and first means capable of producing at least a first portion of the energy which is transmitted by the train and intended to power the oscillator, wherein the first means are configured to provide mechanical torque that varies essentially as a function of the angle of rotational travel of the train, this mechanical torque having at least one stable position, and at least one unstable position, over a period of rotational travel of the train. In a particular embodiment, these first means produce a magnetic torque that varies as a function of time, by combining a diametrically magnetized rotor with a stator comprising cells in the bore receiving the rotor.

SUMMARY OF THE INVENTION

The invention proposes to limit magnetic interaction on an arbor of a moveable component, in particular on a balance staff.

To this end, the invention concerns an arbor of a movable pivoting timepiece component intended to pivot about a pivot axis and including at least one protruding portion having a larger radius around said pivot axis, characterized in that at least said protruding portion is delimited, on either side of said pivot axis, by two surfaces, which define, in projection on a plane perpendicular to said pivot axis, a profile inscribed in a rectangle whose length to width ratio defines a shape proportion which is greater than or equal to 2, the direction of said length defining a main axis.

According to a feature of the invention, at least one rectangular profile portion, delimited on two opposing sides by said two surfaces, comprised in said arbor includes, at least one cutout centered on said pivot axis and extending along a main axis which is that of the length of said rectangle.

According to a feature of the invention, said two surfaces are symmetrical with respect to said pivot axis.

According to a feature of the invention, said two surfaces are plane and parallel to said pivot axis.

The invention also concerns a movable pivoting timepiece component including one such arbor, said arbor being made of steel, said movable component oscillating about a rest position defined by a rest plane passing through said pivot axis, characterized in that, in said rest position of said movable component, said main axis occupies a determined angular position with respect to said rest plane.

According to a feature of the invention, said steel arbor has a high saturation field with a value of more than 1 T, a maximum magnetic permeability higher than 50, and a coercive field greater than 3 kA/m.

The invention also concerns a mechanism including one such movable component returned towards said rest position by elastic return means, said mechanism having a preferred direction of magnetization, and characterized in that, in said rest position, said main axis is substantially orthogonal to said preferred magnetization direction.

According to a feature of the invention, said mechanism is an escapement mechanism, and said movable component is a balance wheel returned to said rest position by at least one balance spring, and said arbor is a balance staff.

The invention also concerns a timepiece movement including at least one such mechanism.

The invention also concerns a watch including at least one such timepiece movement and/or including at least one such mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
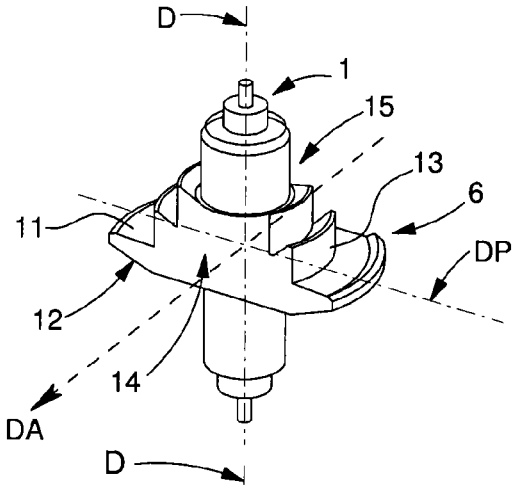
FIG. 1 shows, in the form of a three-dimensional diagram, a first variant of an arbor of a movable component according to the invention, including machined portions of revolution about a pivot axis, including one protruding portion of larger radial dimensions than the others, the arbor including two lateral surfaces that are symmetrical with respect to the pivot axis, and at a distance from each other such that the shape proportion of this protruding portion, in projection on a plane perpendicular to the pivot axis, is greater than 2, and wherein the largest dimension, called the "main axis" extends in a substantially orthogonal manner to a preferred magnetization direction of the immediate environment of the movable component.

The invention more particularly concerns the field of timepiece regulating members for mechanical watches.

The invention proposes to limit magnetic interaction on an arbor of a moveable component, in particular on a balance staff.

The invention thus concerns an arbor of a movable component with optimised geometry in a magnetic environment.

By convention, in the present description an "axis" refers to a virtual geometrical element such as a pivot axis, and an "arbor" to a real mechanical element, formed of one or more parts. For example, a pair of pivots aligned and arranged on either side of a median part of a movable component, to guide the pivoting thereof is also termed an "arbor".

The invention permits watches with a balance spring, pallet lever body and escape wheel that are not magnetic to withstand, without stopping, magnetic fields of high intensity, on the order of 0.5 Tesla, without affecting mechanical performance (chronometry and ageing of the movable components).

Implementation of the invention reduces residual effects in watches with a non-magnetic balance spring, pallet lever body and escape wheel to less than one second per day.

By convention, in the present description an "axis" refers to a virtual geometrical element such as a pivot axis, and an "arbor" to a real mechanical element, formed of one or more parts. For example, a pair of pivots 2A and 2B aligned and arranged on either side of a median part 6 of a movable component 10, to guide the pivoting thereof is also termed an "arbor".

In the explanation set out hereinafter, "magnetically permeable" materials are materials having a relative permeability of between 10 and 10000 such as steels, which have a relative permeability close to 100 for balance staffs, for example, or close to 4000 for the steels commonly used in electric circuits, or other alloys whose relative permeability reaches values of between 8000 and 10000.

"Magnetic materials", for example in the case of pole pieces, are materials able to be magnetized to have a remanent field of between 0.1 and 1.5 Tesla, such as for example "Neodymium Iron Boron" having a magnetic energy density Em close to 512 kJ/$m^3$ and giving a remanent field of 0.5 to 1.3 Tesla. A lower level remanent field, towards the bottom part of the range, may be used when a magnetic material of this type is combined, in a magnetization pair, with an opposing magnetically permeable component of high permeability, closer to 10000 within the range from of 100 to 10000.

"Ferromagnetic" materials means materials whose characteristics are: saturation field Bs>0 at temperature T=23° C., coercive field Hc>0 at temperature T=23° C., maximum magnetic permeability $\mu_R$>2 at temperature T=23° C., Curie temperature Tc>60° C.

More particularly, "ferromagnetic" materials means materials whose characteristics are: saturation field Bs<0.5 T at temperature T=23° C., coercive field Hc<1,000 kA/m at temperature T=23° C., maximum magnetic permeability $\mu_R$<10 at temperature T=23° C., Curie temperature Tc>60° C.

More particularly, "highly ferromagnetic" materials means materials whose characteristics are: saturation field Bs>1 T at temperature T=23° C., coercive field Hc>3,000 kA/m at temperature T=23° C., maximum magnetic permeability μ>50 at temperature T=23° C., Curie temperature Tc>60° C.

"Paramagnetic" materials means materials with a relative magnetic permeability of between 1,0001 and 100, for example for spacer pieces inserted between a magnetic material and an opposing magnetically permeable component or between two magnetic materials, for example a spacer piece between a component and a pole piece. For example, weakly paramagnetic materials (magnetic permeability of less than 2) are CoCr20Ni16Mo7, known in particular by the name of "Phynox®" or nickel-phosphorus NiP (either with a 12% concentration of phosphorus but hardened, or with a phosphorus concentration of less than 12%).

"Diamagnetic" materials means materials with relative magnetic permeability of less than 1 (negative magnetic susceptibility less than or equal to $-10^{-5}$), such as graphite or graphene.

Finally, "soft magnetic" materials, as opposed to "non-magnetic" materials, particularly for shields, are materials exhibiting a high magnetic permeability but high saturation, since they are not required to be permanently magnetized: they must conduct the field as well as possible, so as to reduce the external field. These components can then also protect a magnetic system from external fields. These materials are preferably chosen to have a relative magnetic permeability of between 50 and 200 and with a saturation field of more than 500 A/m.

"Non-magnetic" materials are materials with a relative magnetic permeability very slightly greater than 0.9999, and less than 1.0001, typically like aluminum, brass, silicon, diamond, palladium and similar materials. These materials may generally be obtained via MEMS technology or the LIGA method.

The invention concerns a timepiece arbor 1, for a movable component 10 and optimised for movable component 10 to operate in an environment where there is a residual magnetic field in a preferred direction of magnetization DAP.

It is specified that this arbor 1 is a pivoting axial element, which acts as a support for other components: roller, flange, collet, balance, but which is not formed by these other components, which are driven in, adhesive bonded, welded, brazed or driven onto the arbor, or held by other methods. The characteristics presented below concern only this arbor 1.

"Intrinsic magnetic properties" refers here to all of the following magnitudes: permeability, saturation field, coercive field, Curie temperature, dependent hysteresis curve. Magnetization does not form part of these intrinsic magnetic properties. The magnetization profile of such an arbor after magnetization does not depend on intrinsic magnetic properties alone, but depends notably on the source of the magnetic field which magnetized the arbor and the shape and size of said arbor. For example, the arbor may have non-uniform magnetization even if the intrinsic magnetic properties are uniform.

It should be recalled that a component cannot become, for example, ferromagnetic after being subjected to a magnetic field: a material is either ferromagnetic, or paramagnetic, antiferromagnetic or diamagnetic. This characteristic can be modified by temperature but it cannot be modified by an external field. A distinction must be made between magnetization and the intrinsic magnetic properties of the material.

In the explanation set out hereinafter, "magnetically permeable" materials are materials having a relative permeability of between 10 and 10000 such as steels, which have a relative permeability close to 100 for balance staffs, for example, or close to 4000 for the steels commonly used in electric circuits, or other alloys whose relative permeability reaches values of between 8000 and 10000.

"Magnetic materials", for example in the case of pole pieces, are materials able to be magnetized to have a remanent field of between 0.1 and 1.5 Tesla, such as for example "Neodymium Iron Boron" having a magnetic energy density Em close to 512 kJ/$m^3$ and giving a remanent field of 0.5 to 1.3 Tesla. A lower level remanent field, towards the bottom part of the range, may be used when a magnetic material of this type is combined, in a magnetization pair, with an opposing magnetically permeable component of high permeability, closer to 10000 within the range from of 100 to 10000.

"Ferromagnetic" materials means materials whose characteristics are: saturation field Bs>0 at temperature T=23° C., coercive field Hc>0 at temperature T=23° C., maximum magnetic permeability $\mu_R$>2 at temperature T=23° C., Curie temperature Tc>60° C.

More particularly, "ferromagnetic" materials means materials whose characteristics are: saturation field Bs<0.5 T at temperature T=23° C., coercive field Hc<1,000 kA/m at temperature T=23° C., maximum magnetic permeability $\mu_R$<10 at temperature T=23° C., Curie temperature Tc>60° C.

The possibility of using ferromagnetic materials having specific characteristics simultaneously satisfies the requirement for mechanical strength, magnetic resistance and manufacturability of the components.

More particularly, "highly ferromagnetic" materials means materials whose characteristics are: saturation field Bs>1 T at temperature T=23° C., coercive field Hc>3,000 kA/m at temperature T=23° C., maximum magnetic permeability $\mu_R$>50 at temperature T=23° C., Curie temperature Tc>60° C.

"Paramagnetic" materials means materials with a relative magnetic permeability of between 1,0001 and 100, for example for spacer pieces inserted between a magnetic material and an opposing magnetically permeable component or between two magnetic materials, for example a spacer piece between a component and a pole piece. Weakly paramagnetic materials, having a magnetic permeability of between 1.01 and 2, can be used to implement the invention. Materials such as CoCr20Ni16Mo7, known in particular by the name of "Phynox®" or nickel-phosphorus NiP (either with a 12% concentration of phosphorus but hardened, or with a phosphorus concentration of less than 12%) are weakly paramagnetic and can therefore be used to implement the invention.

The utilisation of non-magnetic materials (magnetic permeability of less than 1.01) is very limiting, because these materials are either difficult to machine, or mechanically unsuitable for the required functions (and thus require a coating or a hardening process to make them ferromagnetic), which explains why the first watch resistant to 15,000 Gauss was only introduced in 2013. For example, non magnetic materials are: aluminum, gold, brass or similar.

"Diamagnetic" materials means materials with relative magnetic permeability of less than 1 (negative magnetic susceptibility less than or equal to $-10^{-5}$), such as graphite or graphene.

Finally, "soft magnetic" materials, as opposed to "non-magnetic" materials, particularly for shields, are materials exhibiting a high magnetic permeability but high saturation, since they are not required to be permanently magnetized: they must conduct the field as well as possible, so as to reduce the external field. These components can then also protect a magnetic system from external fields. These materials are preferably chosen to have a relative magnetic permeability of between 50 and 200 and with a saturation field of more than 500 Nm.

"Non-magnetic" materials are defined as materials with a relative magnetic permeability very slightly greater than 1, and less than 1.0001, typically like silicon, diamond, palladium and similar materials. These materials may generally be obtained via MEMS technology or the LIGA method.

To return to the notion of the preferred direction of magnetization DAP, it is considered useful to specify that this direction is due to the design of a mechanism, and has nothing to do with the fields to which the mechanism is subjected. The direction of magnetization imposed on a component, for example a motor rotor (which is a permanent magnet) must not be confused with the preferred direction of magnetization of a ferromagnetic part: a permanent magnet may have a completely different direction of magnetization from the preferred direction of magnetization (both could even be orthogonal, such as in permanent magnets taking the form of axially magnetized discs). Continuing with the electric motor example, it is possible for a component not to have a preferred direction of magnetization, like the stator which has a virtually symmetrical geometry.

In a preferred embodiment described below in detail and illustrated by the Figures, this movable component 10 is a balance wheel, forming part of a normal timepiece sprung-balance assembly. Those skilled in the art will know how to apply the invention to other movable timepiece components The geometry of a normal staff 1 of a balance 10, which is relatively standard in the watch industry, is not optimised to limit the magnetization thereof under an external field. In fact, the median portion 6 of staff 1, which has a larger radius RMAX, is strongly magnetized by a magnetic field that is orthogonal or oblique with respect to the direction of pivot axis D. Because of this magnetization, in the presence of an environmental field (an external field or field created by the magnetized components of the movement or of the watch), staff 1 is subjected to a high magnetic torque.

Preferably, the staff is a ferromagnetic component, notably made of steel, and is in a demagnetized initial state (and cannot in any event be used as a permanent magnet). Indeed, the invention contributes to the elimination of magnetic disturbance of the timepiece movement, and the invention makes it possible to reduce or eliminate any accidental magnetization in the staff.

Balance 10 forms part of an escapement mechanism 20 in a movement 30 of a watch 40.

The invention proposes to modify the geometry of balance staff 1, by modifying the shape proportion of the protruding portion 11, which is the portion of the balance staff taking up the most radial space, by giving it, in projection on a plane perpendicular to pivot axis D of staff 1 of balance 10, a shape proportion very different from 1, preferably greater than or equal to 2.

The idea is to reduce one of the two dimensions x or y (in projection in a plane perpendicular to pivot axis D). The simplest way to do this is to limit staff 1 locally by two surfaces 14, 15, substantially parallel to axis D, said surfaces 14, 15 are preferably two planes parallel to axis D; indeed, if the surfaces, notably the planes, are not parallel, a wider portion then remains which may be more highly magnetized than the rest. These two surfaces 14 and 15 are preferably very close to each other, to reduce magnetization in that direction, and to clearly define a single preferred magnetization direction in the x, y plane.

Preferably, and as seen in the Figures, these two surfaces 14 and 15 are symmetrical with respect to pivot axis D of staff 1.

The protruding portions are oriented with their main axes parallel to each other.

The projection of this protruding portion 11 in a plane perpendicular to pivot axis D of balance 10, has a profile 12, which is inscribed in a rectangle R symmetrical with respect to two orthogonal axes, including a main axis DP along which extends the largest dimension of protruding portion 11. The shape proportion is the ratio between the two dimensions of the rectangle: length LR and width LA.

Consequently, after transformation, balance staff 1 no longer has rotational symmetry.

According to the invention, in the rest position of the balance, this main axis DP, along which extends the largest dimension of protruding portion 11, is in a substantially orthogonal position with respect to the preferred magnetization direction DA of the environment of the movement. "Substantially orthogonal" means an angle of between 80° and 100°; in particular, the angle is 90°. This preferred direction DA is generally determined by bars, bridges, screws or suchlike; it depends directly on design and is generally quite evident, by examining the shape proportion of the steel components close to the axis; in ambiguous situations, said direction can easily be determined simply by performing a simulation with finished elements or equivalent loads.

The "rest" position of the balance corresponds to that which it occupies when the balance spring is at rest: it is the least frequent position of the movement, but, as explained below, it is the mean position and, for very intense external fields, it is the position which defines the resulting magnetization.

In a particular embodiment, the largest dimension of the balance roller is perpendicular to the escapement line, which maximises surface effects relative to volume effects, so as to reduce magnetization in the field direction to a minimum, and thereby "compass" effects which create a disturbing torque.

The combination of staff 1 manufactured in a profile 12, with the substantially orthogonal orientation of its main axis DP with respect to preferred magnetization direction DA, is referred to as "magnetically optimised geometry".

Several variants are illustrated in the Figures.

Figure 6:
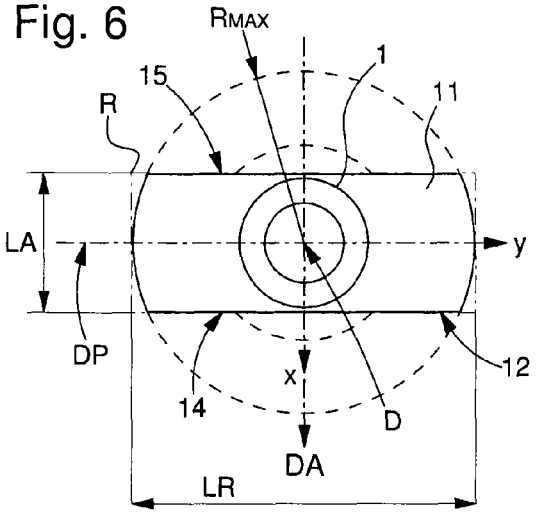
FIG. 6 is an end view, in the direction of the pivot axis, of an arbor according to FIG. 1, illustrated as being the transformation of an arbor entirely of revolution and of larger radius RMAX.
Figure 7:
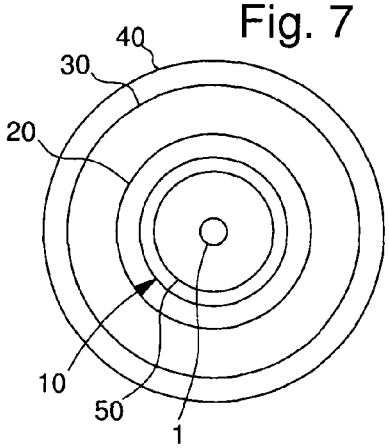
FIG. 7 shows block diagrams of a timepiece comprising a movement including a mechanism including a movable component equipped with an arbor according to the invention.

FIG. 1 shows a balance staff 1 with a realistic magnetically optimised geometry. The widest portions, which are used as a support, have a high shape proportion, the largest dimension being oriented with its main axis DP in the direction substantially orthogonal to the preferred magnetization direction DA of the environment of the movement. This staff 1 is illustrated on a conventional balance staff base, with turned shoulders of pivots and supports: for supporting collets, rims, seats, double rollers or other elements. In this example, the portion with the largest diameter 11 acts as a support for one face of a rim 50, not shown in the Figure, staff 1 including a shoulder 13 for centering the rim; profile 12 is achieved here by machining, particularly by milling or turning, or suchlike, two opposing surfaces 14 and 15, as also seen in FIG. 6, these surfaces are plane surfaces in a simplified preferred embodiment. This variant makes it possible to transform, inexpensively, existing balance staffs to adapt them to the invention, without requiring any geometric modification of the other components of the balance, or of the mechanism in which it is integrated.

Figure 2:
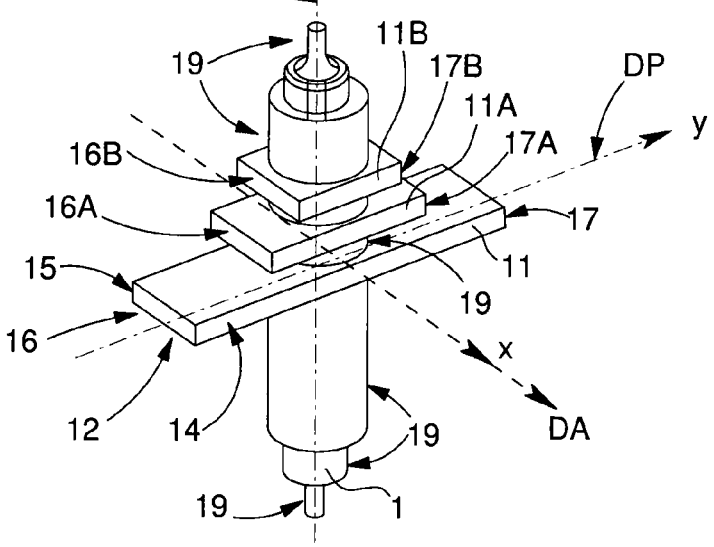
FIG. 2 shows, in a similar manner to FIG. 1, a second variant of an arbor of a movable component according to the invention, wherein the protruding portion has a rectangular profile with a shape proportion greater than 2, and wherein some portions forming supports for other components also have a rectangular profile.

FIG. 2 shows a diagram of balance staff 1 with a magnetically optimised geometry. The widest portions, which are used as a support, have a high shape proportion, the largest dimension being oriented with its main axis DP in the direction substantially orthogonal to the preferred magnetization direction DA of the environment of the movement. Although some shoulders, notably the pivots, remain of revolution, protruding portion 11 is of prismatic shape here, with opposing surfaces 14 and 15 and end surfaces 16 and 17 on the small sides of the rectangular envelope of profile 12, which are all plane, in a particular embodiment. For other support functions of balance staff 1, other portions 11A, 11B with a shape proportion of more than 1 are arranged parallel to the main protruding portion 11, and all have their main axis DP in the direction substantially orthogonal to preferred magnetization direction DA. The end milling of faces 16A, 16B, 17A, 17B, combined with the milling of extensions of planes 14 and 15 in these portions 11A, 11B, offers the advantage of allowing magnetic field leakage, and further reducing residual magnetization.

Figure 3:
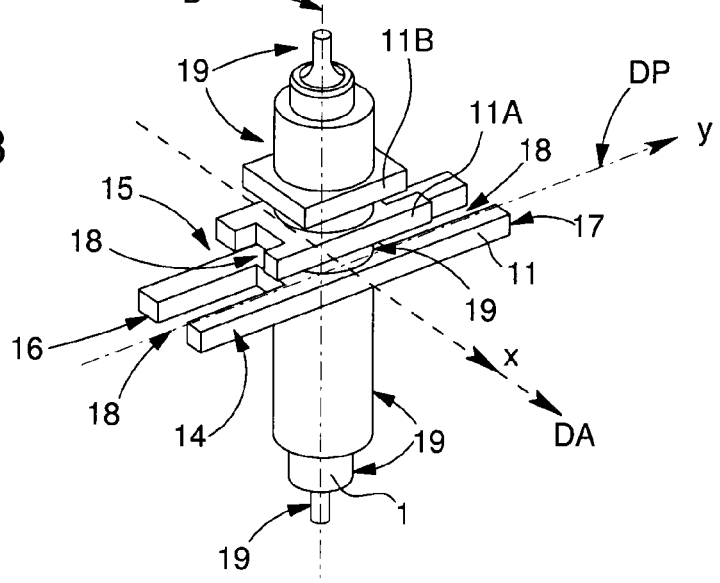
FIG. 3 shows a variant of FIG. 2, wherein the protruding portion and another rectangular profile portion include cutouts extending along their largest dimension.

FIG. 3 illustrates an alternative optimised geometry, derived from that of FIG. 2. In this case, the longest support portions, of main protruding portion 11, but also of the other portions 11A, 11B, are cut and comprise cutouts 18, notably in the form of slots, to induce partial self demagnetization in the absence of an external field. These cutouts 18 extend in a direction parallel to main axis DP. As previously, the longest portions, used as a support, have a high shape proportion, the largest dimension being oriented with its main axis DP in the direction substantially orthogonal to the preferred magnetization direction DA of the environment of the movement. Preferably, the depth of cutouts 18 is greater than or equal to half the length of the portion 11 or 11 concerned, exceeding the mean radius of the cylindrical portion of staff 1.

Here too, the protruding portions and the cutouts are symmetrical with respect to pivot axis D of staff 1.

Although the embodiment delimited by surfaces 14 and 15, which are parallel planes, is very advantageous, in terms of both results and production costs, it should be noted that, as soon as the shape proportion is higher than 2 according to the invention, a preferred magnetization direction is established in the xy plane, which is confirmed by simulations with finished elements.

Preferably, to avoid creating unbalances, staff 1 according to the invention is symmetrical with respect to a plane passing through pivot axis D and parallel to main axis DP.

The surfaces of revolution 19, notably the pivots and cylindrical body of the balance staff, may be identical to the pivots and cylindrical body of a conventional balance staff: the mechanical performance of the component is thus unaltered with respect to existing balance staffs.

The staffs shown in the Figures have a preferred magnetization direction parallel to main axis DP, selected to be substantially orthogonal to preferred magnetization direction DA of the environment of the movement (when the balance spring is at rest).

Case of a Conventional Balance Staff

As regards the residual effect, for a conventional balance staff, there are two possible magnetization regimes, following exposure to an intense magnetic field, notably under the influence of a powerful static external field (>5 000 kA/m), capable of saturating the carbon steel (20AP) of which the balance staff is generally manufactured, and oriented orthogonally to the pivot axis of the staff (the case where the field is parallel to the axis is ignored since it does not cause significant defects in chronometry):

First case: the motion of balance 10 ceases under the external field, and movement 30 is stopped. Since the motion ceases close to its rest position (generally at less than 20° since the staff has cylindrical symmetry and the balance spring is not magnetic), the remanent field in the balance staff is oriented like the external field "seen" from the rest position.

Second case: the motion does not cease, and therefore magnetization of the staff occurs dynamically: on each oscillation, the direction of the external field "seen" by the staff changes, the field in the material undergoes several hysteresis cycles with the gradual formation (in each cycle) of a remanent field (the external field is intense and therefore strongly magnetizes the staff, but, when the orientation of the staff changes, the same external field reduces and partially reorients the remanent field created). Due to the gradual and cyclical formation of permanent magnetization, the remanent field eventually formed (after several complete oscillations, i.e. after 0.5 seconds to 1 second, depending on the frequency) in the staff will be oriented as if the staff were immobile in its mean position, i.e. in its rest position (exactly as if the staff had stopped under the field).

Independently of the motion ceasing under the field, the remanent field will preferably be oriented like the external field whereas the remanent field created in the environment of the movement will be oriented according to the orientation of the fixed ferromagnetic components (bars, screws, bridges), in preferred magnetization direction DA.

After the elimination of the external field, a residual magnetic torque acts on the balance staff as on the hand of a compass. The rate defect depends on the symmetry of the magnetic torque with respect to the rest position of the balance (angle of oscillation=0): if the torque is an odd function of the angle, the rate defect is maximal, if the torque is an even function of the angle, the rate defect is zero (but the latter result is very unlikely for a conventional staff).

Case of a Balance Staff According to the Invention

The residual effect for a geometrically optimised staff 1 according to the invention is different from that observed for a conventional staff.

The staffs 1 shown in FIG. 1 and in FIG. 2 have a shape proportion of around 2. For staffs having a shape proportion of 2 or more than 2, the possible magnetization regimes are:

First case: the motion ceases under the external field. The presence of a preferred magnetization direction weakens magnetization in the orthogonal direction.

Second case: the motion does not cease, thus magnetization of the staff occurs dynamically: with each oscillation, the direction of the external field "seen" by the staff changes, the field in the material undergoes several hysteresis cycles with the gradual formation (in each cycle) of a remanent field.

Due to the presence of a preferred magnetization direction, the magnetization is:

oriented in that direction, if the external field is oriented in any direction other than the precise orthogonal direction;

oriented in the orthogonal direction but very weak, if the external field is oriented in the direction orthogonal to main axis DP of the staff.

Since main axis DP of staff 1 is substantially orthogonal to the preferred magnetization direction DAP of the environment, for almost all possible orientations of the external field (except orientation in the preferred magnetization direction DAP of the environment) the resulting residual magnetic torque on staff 1 is an even function of the angle of oscillation, which makes the residual rate defect almost zero.

Figure 4:
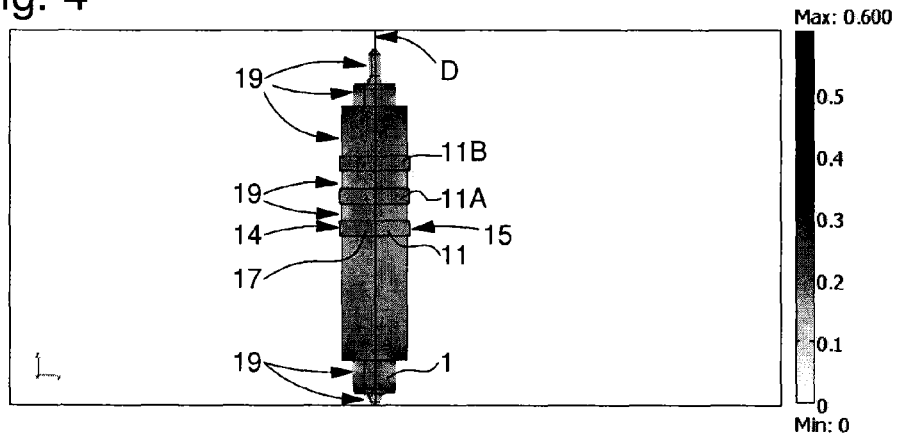
FIG. 4 shows, in a schematic manner, an end view in the direction of the main axis of the arbor of FIG. 2, in which the more intense the grey shading, the higher the remanent field, after exposure to a magnetic field in the preferred magnetization direction of the environment of the movable component.
Figure 5:
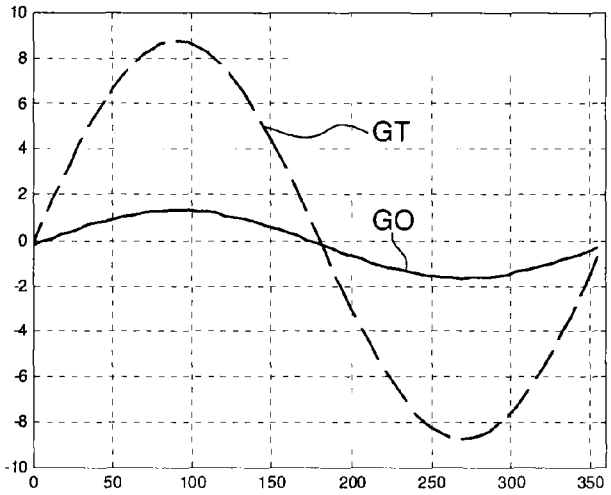
FIG. 5 illustrates, in the form of a graph, a comparison of the magnetic torques exerted on a conventional balance staff in graph GT shown in dashed lines, and on an optimised staff according to the invention in graph GO shown in a continuous line. On the abscissa is the angle in degrees, and on the ordinate the torque exerted on the balance in mN.mm.

If the field is oriented exactly in the preferred magnetization direction DAP of the environment, the staff is magnetized in the same direction, and therefore orthogonally to main axis DP, but in that case magnetization is weak, less than 0.2 T, as shown in FIG. 4, which illustrates the remanent field distribution, after magnetization at 0.2 T in the direction orthogonal to main axis DP, of an optimised balance staff 1 made of 20AP steel. In this case, the magnetic torque is an odd function of the angle of oscillation, but it is between 10 and 100 times (depending on the geometry) lower than the torque acting on a conventional staff, as seen in FIG. 5, which illustrates, in the form of a graph, a comparison of the magnetic torques exerted on a conventional balance staff, in graph GT shown in dashed lines, and on an optimised staff 1 according to the invention, in graph GO shown in a continuous line. On the abscissa is the angle in degrees, and on the ordinate the torque exerted on the balance in mN.mm. The residual rate defect is then reduced by a factor of between 3 and 10.

Independently of the direction of the external field, optimisation of the geometry of the staff thus considerably reduces the residual rate defect.

Preferably, the material of staff 1 is magnetically homogeneous in the simple embodiment illustrated by the Figures. This particular embodiment does not in any manner preclude embodiments where staff 1 is magnetically inhomogeneous.

In a particular variant, staff 1 is in one piece and made of several aligned portions. This one piece staff 1 is magnetically inhomogeneous and has intrinsic magnetic properties, which are: permeability, field saturation, coercive field, Curie temperature and dependent hysteresis curve, which are not uniform throughout its volume. More specifically, this staff 1 is magnetically inhomogeneous with a variation in the intrinsic magnetic properties of one piece staff 1 either in the axial direction of pivot axis D of one piece staff 1, or radially with respect to pivot axis D, or both in the axial direction of pivot axis D of said one piece staff 1 and radially with rotational symmetry with respect to pivot axis D.

The invention provides significant advantages:

increased under field stopping field for watches with a non-magnetic balance spring, pallet lever body and escape wheel;

reduced residual effect for watches with a non-magnetic balance spring, pallet lever body and escape wheel;

identical mechanical performance to state of the art watches.

The invention thus makes it possible to modify the geometry of the balance staff (and not of the entire balance), because the staff is generally the only magnetic component, which is difficult to replace with a non-magnetic material. Indeed, it is the influence of the actual staff that has to be reduced, and this object is achieved by the invention.

It is not necessary to adapt the geometry of the components mounted on the balance staff, since the support surfaces are maintained, although they are modified locally by implementation of the invention, compared to a conventional balance.

In summary, although it is of course possible to envisage, around the inventive concept of the invention, very specific different designs according to the particular case, and especially in order to simplify the manufacture and attachment of components, the most important thing is to apply this basic concept: a preferred magnetization direction of the balance staff must be defined, adapted to the preferred magnetization direction of the environment. The simplest way is to have a prismatic rather than cylindrical geometry (with a shape proportion of 2 or more).

The invention thus makes it possible to obtain an oscillator with excellent regularity of rate, since it is insensitive to external magnetic disturbance, unlike prior art attempts (such as, for example, an oscillator formed by the interaction of a permanently magnetized arbor with a stator, but whose frequency greatly depends on the magnetization of the axis, and is thus highly sensitive to any external magnetic disturbance, and cannot be used for an accurate timepiece movement).

To achieve this result, it was necessary to study the magnetization mechanism of a moving ferromagnetic component, a problem which has never been addressed in watchmaking and which was only studied in the field of rotating heavy machinery from 2000 onwards.

It is understood that there is a great difference between, on the one hand, a magnetically passive component, such as staff 1 of the invention (ferromagnetic, not magnetized and in principle a poor permanent magnet), and on the other hand, an magnetically active component such as a permanent magnet (made with a specific ferromagnetic material, with a very high Curie point and coercive field, and deliberately magnetized in a specific direction before being integrated in the design, using extremely high magnetization fields, on the order of 3 T to 6 T). Those skilled in the art cannot therefore transfer known results for a permanent magnet to non-magnetized ferromagnetic components, whose behaviour is completely different and which form much more complex systems since their magnetic response greatly depends on their geometry, surface effects and the environment in the movement.

Those skilled in the art may refer to various articles on this subject:

Diala E. A. (2008), "Magnetodynamic vector hysteresis models for steel laminations of rotating electrical machines", Helsinki University of Technology, ISBN 978-951-22-9276-9/978-951-22-9277-6, ISSN 1795-2239/1795-4584.

Fuzi, J. (1999), "Computationally efficient rate dependent hysteresis model", COMPEL, 18, 445-457.

Zirka, S. E., Moroz, Y. I., Marketos, P., and Moses, A. J. (2004c), "Properties of dynamic Preisach models"', Physica B: Condensed Matter, 343, 85-89.

Zirka, S. E., Moroz, Y. I., Marketos, P., and Moses, A. J. (2005b), "A viscous-type dynamic hysteresis model as a tool of loss separation in conducting ferromagnetic laminations", IEEE Trans. Magn., 41, 1109-1111.

The invention claimed is:

1. An arbor of a movable pivoting timepiece component configured to pivot about a pivot axis and comprising:

at least one protruding portion of which a main protruding portion defines the largest radius of the arbor about the pivot axis, wherein at least the main protruding portion is delimited, on either side of the pivot axis, by two surfaces that are symmetrical with respect to the pivot axis and which define, in projection on a plane perpendicular to the pivot axis, a profile inscribed in a rectangle whose length to width ratio defines a shape proportion which is greater than or equal to 2, the direction of the length defining a main axis, wherein the at least one the protruding portion, of rectangular profile delimited on two opposing sides by the two surfaces in the arbor, includes, to induce partial self-demagnetization in absence of an external field, at least one slot centered on the pivot axis and extending along the main axis and whose depth is greater than or equal to half the length of the protruding portion including the slot concerned exceeding the mean radius of the cylindrical portion of the arbor, and wherein the arbor is in one piece.

2. The arbor according to claim 1, wherein the arbor includes at least one secondary protruding portion having, in projection on a plane perpendicular to the pivot axis, a rectangular profile delimited on two opposing sides by the two surfaces.

3. The arbor according to claim 1, wherein the two surfaces are plane and parallel to the pivot axis.

4. The arbor according to claim 1, wherein the arbor is made of steel.

5. The arbor according to claim 1, wherein the arbor is in one piece and is made of one or more aligned portions, wherein the one piece arbor is magnetically inhomogeneous and has intrinsic magnetic properties that are non-uniform throughout volume thereof.

6. The arbor according to claim 5, wherein the arbor is magnetically inhomogeneous, with a variation in the intrinsic magnetic properties of the one piece arbor either in the axial direction of the pivot axis of the one piece arbor, or radially with respect to the pivot axis, or both in the axial direction of the pivot axis of the one piece arbor and radially with rotational symmetry with respect to the pivot axis.

7. A movable component configured to oscillate about a rest position defined by a rest plane passing through a pivot axis, and the movable component cooperating with elastic return means configured to return the movable component to a rest position, the movable component comprising:

an arbor configured to pivot about the pivot axis and including at least one main protruding portion defining the largest radius of the arbor about the pivot axis, wherein the movable component is a timepiece balance wheel, and wherein the at least the protruding portion is delimited, on either side of the pivot axis, by two surfaces that are symmetrical with respect to the pivot axis and which define, in projection on a plane perpendicular to the pivot axis, a profile inscribed in a rectangle whose length to width ratio defines a shape proportion that is greater than or equal to 2, the direction of the length defining a main axis, and wherein the arbor is made of steel, and the main axis of the arbor, in the plane orthogonal to the arbor, occupies a determined angular position with respect to the rest plane, in the rest position of the movable component, the movable component having a preferred direction of magnetization which is substantially orthogonal to the main axis of the arbor in the rest position.

8. The movable component according to claim 7, wherein in the arbor wherein the at least one the protruding portion, of rectangular profile delimited on two opposing sides by the two surfaces in the arbor, includes, to induce partial self-demagnetization in absence of an external field, at least one slot centered on the pivot axis and extending along the main axis and whose depth is greater than or equal to half the length of the protruding portion including the slot concerned exceeding the mean radius of the cylindrical portion of the arbor, and wherein the arbor is in one piece.

9. A timepiece mechanism comprising a movable component according to claim 7 returned to the rest position by elastic return means in the timepiece mechanism.

10. The timepiece mechanism comprising a movable component according to claim 9 returned to the rest position by elastic return means in the timepiece mechanism.

11. The timepiece mechanism according to claim 9, wherein the arbor is made of steel, has a high saturation field with a value higher than 1 T, a maximum magnetic permeability greater than 50, and a coercive field higher than 3 kA/m.

12. The timepiece mechanism according to claim 10, wherein the arbor is made of steel, has a high saturation field with a value higher than 1 T, a maximum magnetic permeability greater than 50, and a coercive field higher than 3 kA/m.

13. The timepiece mechanism according to claim 9, wherein the timepiece mechanism is an escapement mechanism, and wherein the movable component is a balance wheel returned to the rest position by at least one balance spring forming the elastic return means, and wherein the arbor is a balance staff.

14. A timepiece movement comprising at least one timepiece mechanism according to claim 9.

15. A timepiece movement comprising at least one timepiece mechanism according to claim 10.

16. A watch comprising at least one timepiece mechanism according to claim 9.

* * * * *